US012757997B2

(12) United States Patent
Yang

(10) Patent No.: US 12,757,997 B2
(45) Date of Patent: Oct. 13, 2026

(54) COSMETIC CONTAINER

(71) Applicant: SHYA HSIN PACKAGING INDUSTRY (CHINA) CO., LTD., Kunshan (CN)

(72) Inventor: Haiying Yang, Kunshan (CN)

(73) Assignee: SHYA HSIN PACKAGING INDUSTRY (CHINA) CO., LTD., Kunshan (CN)

( * ) Notice: Subject to any disclaimer, the term of this patent is extended or adjusted under 35 U.S.C. 154(b) by 324 days.

(21) Appl. No.: 18/580,172

(22) PCT Filed: Aug. 14, 2022

(86) PCT No.: PCT/CN2022/112344
§ 371 (c)(1),
(2) Date: Jan. 18, 2024

(87) PCT Pub. No.: WO2023/035862
PCT Pub. Date: Mar. 16, 2023

(65) Prior Publication Data

US 2024/0324749 A1 Oct. 3, 2024

(30) Foreign Application Priority Data

Sep. 7, 2021 (CN) ..... 202111043422.3

(51) Int. Cl.
*A45D 33/02* (2006.01)
*A45D 33/24* (2006.01)

(52) U.S. Cl.
CPC ..... *A45D 33/025* (2013.01); *A45D 33/24* (2013.01); *A45D 2200/056* (2013.01)

(58) Field of Classification Search
None
See application file for complete search history.

(56) References Cited

U.S. PATENT DOCUMENTS

| | | | | |
|---|---|---|---|---|
| 1,597,378 | A * | 8/1926 | Kendall | A45D 33/006 132/303 |
| 2018/0116371 | A1* | 5/2018 | Kim | B05B 11/1001 |
| 2018/0207658 | A1 | 7/2018 | Lee | |

FOREIGN PATENT DOCUMENTS

| | | | |
|---|---|---|---|
| CN | 105101834 | A | 11/2015 |
| CN | 205682740 | U | 11/2016 |
| CN | 109661189 | A | 4/2019 |
| CN | 211672824 | U | 10/2020 |
| CN | 212661329 | U | 3/2021 |

(Continued)

*Primary Examiner* — Tatiana L Nobrega
(74) *Attorney, Agent, or Firm* — Bayramoglu Law Offices LLC

(57) ABSTRACT

A cosmetic container includes a housing, a powder tray, an inner lid, and a button assembly. A housing includes an upper lid and a lower lid, where one side of the upper lid and one side of the lower lid are hinged to each other, the other side of the upper lid and the other side of the lower lid each are an open side, and the open side is configured to be locked and unlocked. When a button is pressed, the other end of the button stretches into a space under an oblique protrusion of the powder tray to lift the powder tray. The lifted powder tray is close to the inner lid and compresses a pump spring. A pump seat is close to a pump pressure rod. An air pressure in the pump seat is increased, such that a pump piston is lifted to expose a powder inlet.

12 Claims, 5 Drawing Sheets

(56) References Cited

FOREIGN PATENT DOCUMENTS

| | | | |
|---|---|---|---|
| CN | 113576145 | A | 11/2021 |
| CN | 113827022 | A | 12/2021 |
| KR | 101431386 | B1 | 8/2014 |
| KR | 102101103 | B1 | 4/2020 |

* cited by examiner

COSMETIC CONTAINER

CROSS REFERENCE TO THE RELATED APPLICATIONS

This application is the national phase entry of International Application No. PCT/CN2022/112344, filed on Aug. 14, 2022, which is based upon and claims priority to Chinese Patent Application No. 202111043422.3, filed on Sep. 7, 2021, the entire contents of which are incorporated herein by reference.

TECHNICAL FIELD

The present disclosure relates to a container, and in particular to a cosmetic container.

BACKGROUND

For existing cosmetic containers such as an air cushion case, a cosmetic is directly exposed to an outside environment when used, and thus may be easily contaminated. The consumption of cosmetic cannot be accurately controlled to limit waste. Moreover, after the cosmetic is used up, the empty container is abandoned but not recycled. This is not environment-friendly.

SUMMARY

The present disclosure provides a cosmetic container to overcome the above defects. The cosmetic container can reduce contamination of the cosmetic when used, and can take out a required amount of the cosmetic powder to prevent waste. In addition, after the cosmetic is used up, a liner of the container can be replaced, thereby being more environment-friendly.

To solve the technical problem, the present disclosure adopts the following technical solutions: A cosmetic container includes a housing, where the housing includes an upper lid and a lower lid, one side of the upper lid and one side of the lower lid are hinged to each other, the other side of the upper lid and the other side of the lower lid each are an open side, and the open side is configured to be locked and unlocked;

a powder tray, where the powder tray and a pump seat are fixedly combined and form an annular chamber, cosmetic powder is provided in the annular chamber, a piston seals and covers an opening of the annular chamber, the piston is configured to slide on an inner wall of the annular chamber in a sealing manner, a pump body is nested in a center of the pump seat, a unidirectional pump valve communicated with the annular chamber is provided at a bottom of the pump seat, the pump valve is configured to allow the cosmetic powder to only flow out of the annular chamber unidirectionally, and an oblique protrusion is provided at a bottom of the powder tray;

an inner lid detachably covering an upper aperture of the lower lid, where the inner lid and the lower lid are fixed relatively, the powder tray and the pump seat are axially and movably limited in a space under the inner lid, a powder outlet is formed in a top of the inner lid, a pump pressure rod is fixedly provided at a bottom of the inner lid, the pump pressure rod is configured to move along an axial direction in an inner ring of the pump seat, a hollow pump connecting rod is fixedly provided in a center of the pump pressure rod, a side of the hollow pump connecting rod away from the inner lid is provided with a powder inlet, the powder inlet is communicated with a hollow portion of the hollow pump connecting rod, the powder outlet is communicated with the powder inlet through the hollow portion of the pump connecting rod, an end of the pump connecting rod away from the inner lid is provided with a limit protrusion, a pump piston is slidably sleeved on the pump connecting rod, the limit protrusion is configured to stop the pump piston from sliding out of the pump connecting rod, the pump piston is configured to close and open the powder inlet, the inner ring of the pump seat is slidably sleeved on the pump piston, a pump spring is further provided, one end of the pump spring elastically abuts against the pump pressure rod, and the other end of the pump spring is fixed; and a button assembly including a button seat, a button spring, and a button, where the button seat is provided at a bottom of the lower lid, the button is slidably provided on the button seat, one end of the button is provided in the open side of the lower lid, the other end of the button is configured to stretch into a space under the oblique protrusion, and the button spring is provided between the button seat and the button.

Preferably, a side of the lower lid is provided with a button aperture; and one end of the button is provided at the button aperture, and the other end of the button is configured to stretch into the space under the oblique protrusion.

Preferably, the inner lid is elastically and detachably clamped at the upper aperture of the lower lid.

Preferably, the other end of the pump spring elastically abuts against the pump body.

Preferably, two oblique protrusions are symmetrically provided at the bottom of the powder tray.

Preferably, the inner lid is elastically clamped with the lower lid through a fastener.

Preferably, an inner bottom of the upper lid is provided with a mirror.

The present disclosure has the following beneficial effects: The cosmetic container includes a housing, a powder tray, an inner lid, and a button assembly. The housing is configured to accommodate the powder tray, the inner lid and the button assembly. The powder tray is configured to store cosmetic powder. The inner lid is configured to take out the cosmetic powder. The powder tray and the inner lid form a replaceable liner. The button assembly is configured to control a taking amount of the cosmetic powder. The cosmetic is usually sealed and stored in the powder tray. In response to use, the button is pressed and the cosmetic powder is taken out. The present disclosure can reduce contamination of the cosmetic powder when used, and can take out a required amount of the cosmetic powder to prevent waste.

In the figures: 1: housing, 11: upper lid, 12: lower lid, 2: powder tray, 21: annular chamber, 22: piston, 23: pump body, 24: pump valve, 25: pump spring, 26: oblique protrusion, 27: pump seat, 3: inner lid, 31: powder outlet, 32: pump pressure rod, 33: pump connecting rod, 331: powder inlet, 332: limit protrusion, 34: pump piston, 35: fastener, 4: button assembly, 41: button seat, 42: button spring, 43: button, 5: cosmetic powder, and 6: mirror.

DETAILED DESCRIPTION OF THE EMBODIMENTS

In order to understand the technical means of the present disclosure more clearly and implement the technical means according to contents in the specification, specific implementations of the present disclosure will be further described below in detail with reference to the accompanying drawings and embodiments. The embodiments described below are intended to illustrate the present disclosure, rather than limit the scope of the present disclosure.

Figure 1:
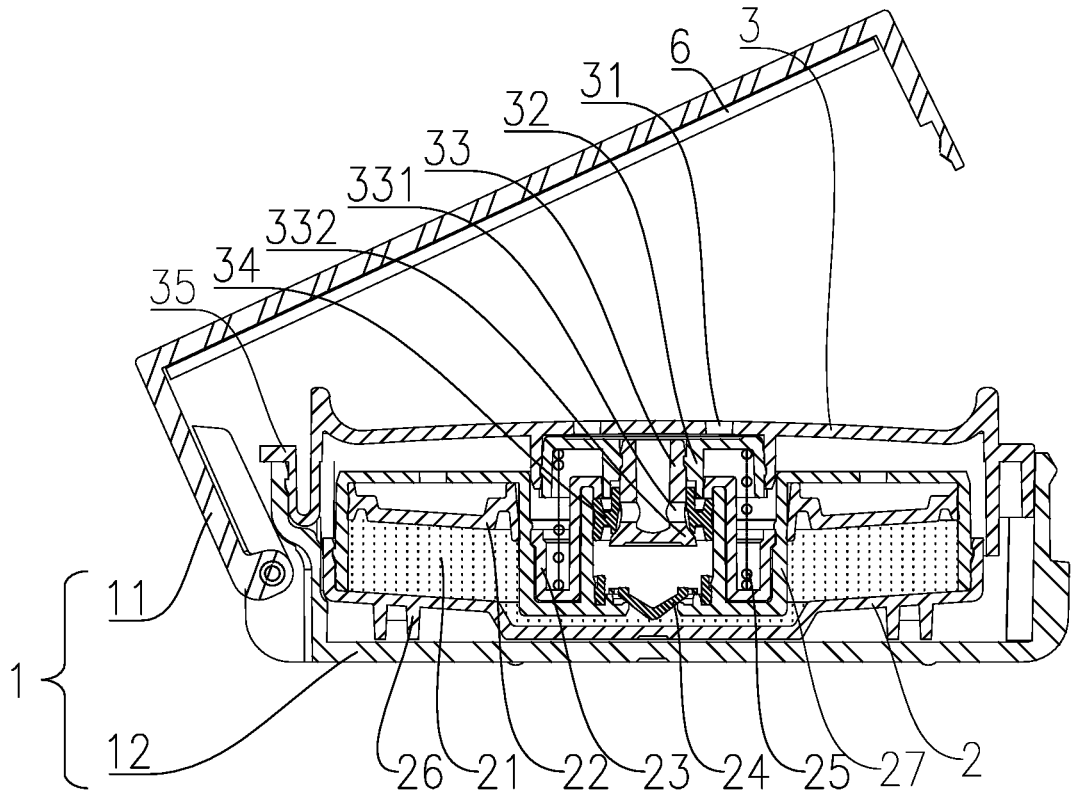
FIG. 1 is an overall sectional view according to the present disclosure.
Figure 2:
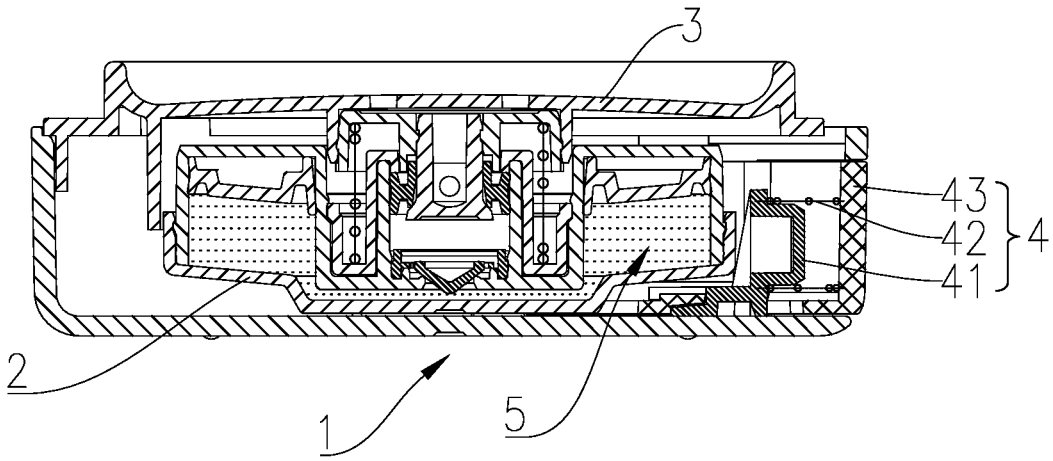
FIG. 2 is a schematic sectional view in another direction according to the present disclosure.
Figure 3:
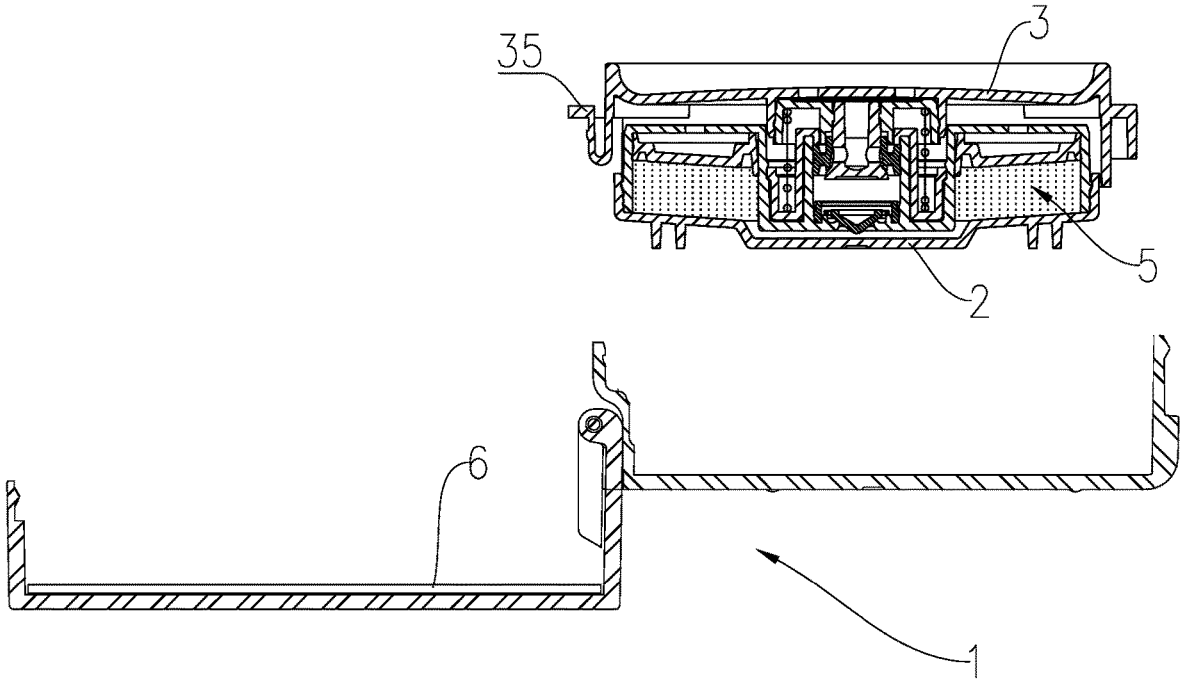
FIG. 3 is a schematic sectional view in which a liner (formed by a powder tray and an inner lid) is separated from a housing according to the present disclosure.
Figure 4:
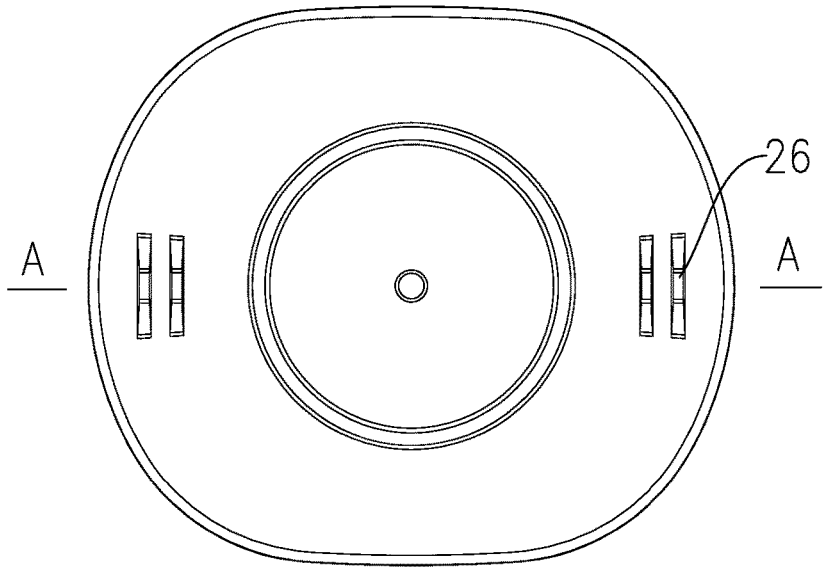
FIG. 4 is a bottom view of a powder tray.
Figure 5:
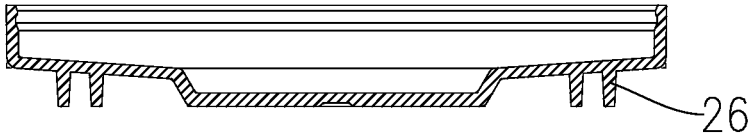
FIG. 5 is a sectional view along A-A in FIG. 4.
Figure 6:
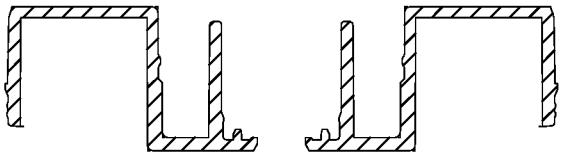
FIG. 6 is an axially sectional view of a pump seat.
Figure 7:
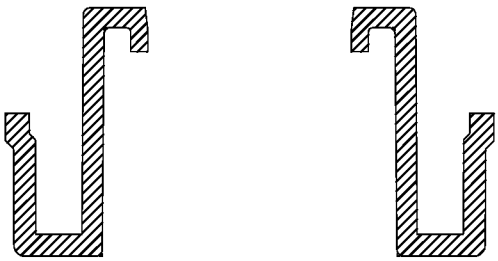
FIG. 7 is an axially sectional view of a pump body.
Figure 8:
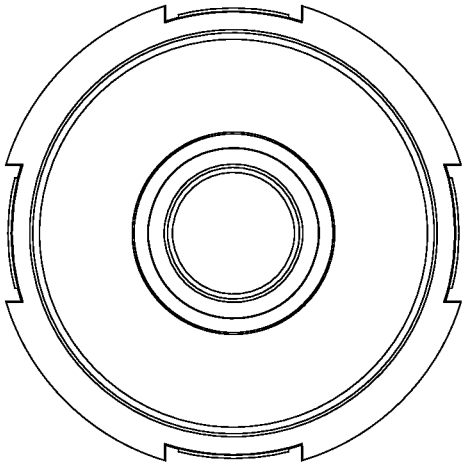
FIG. 8 is a top view of a pump pressure rod.
Figure 9:
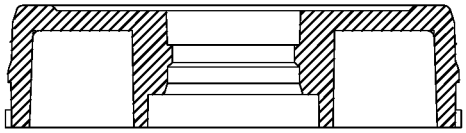
FIG. 9 is an axially sectional view of a pump pressure rod.
Figure 10:
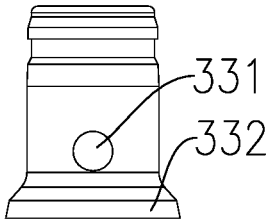
FIG. 10 is a schematic view of a pump connecting rod.
Figure 11:
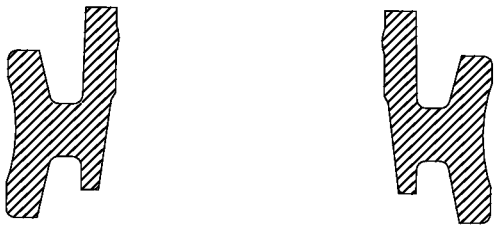
FIG. 11 is an axially sectional view of a pump piston.
Figure 12:
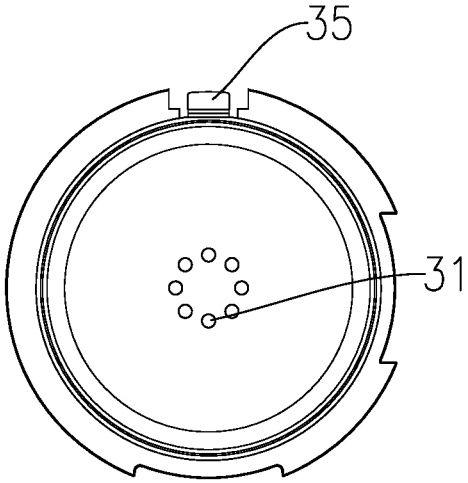
FIG. 12 is a top view of an inner lid.
Figure 13:
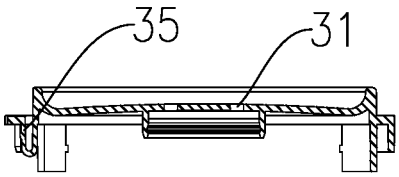
FIG. 13 is an axially sectional view of an inner lid.

A cosmetic container provided by the present disclosure is described in detail in a specific embodiment. As shown in FIG. 1 to FIG. 3, housing 1 of the cosmetic container includes upper lid 11 and lower lid 12. One side of the upper lid 11 and one side of the lower lid 12 are hinged to each other. The other side of the upper lid 11 and the other side of the lower lid 12 each are an open side. The open side is configured to be locked and unlocked, which is a known technology, and is realized through a button 43 opening structure. For example, a groove and a protrusion clamped to each other are respectively provided at an inner side of the upper lid 11 and an outer side of the lower lid 12 to realize locking and unlocking. This is not repeated herein.

As shown in FIG. 4 to FIG. 7, powder tray 2 and pump seat 27 are fixedly combined and form annular chamber 21. Cosmetic powder 5 is provided in the annular chamber 21. The cosmetic powder 5 may be air cushion powder and the like, which is not repeated herein. Piston 22 seals and covers an opening of the annular chamber 21. The piston 22 is configured to slide on an inner wall of the annular chamber 21 in a sealing manner. While taking a sealing effect, the piston can press the powder for ease of suction. Pump body 23 is nested in a center of the pump seat 27. Unidirectional pump valve 24 communicated with the annular chamber 21 is provided at a bottom of the pump seat 27. The pump valve 24 is configured to allow the cosmetic powder 5 to only flow out of the annular chamber 21 unidirectionally, and can prevent the cosmetic powder 5 from flowing back to the annular chamber 21. Oblique protrusion 26 is provided at a bottom of the powder tray 2.

As shown in FIG. 8 to FIG. 13, inner lid 3 detachably covers an upper aperture of the lower lid 12. The powder tray 2 and the inner lid 3 are combined to form a liner. After the cosmetic powder 5 is used up, the housing 1 is abandoned unnecessarily, and can be used continuously by replacing the liner. Therefore, the whole cosmetic container is more environment-friendly to prevent waste. The inner lid 3 and the lower lid 12 are fixed relatively. When the powder tray 2 is lifted, the inner lid 3 does not fall out of the upper aperture of the lower lid 12. The powder tray 2 and the pump seat 27 are axially and movably limited in a space under the inner lid 3. Limited in the space under the inner lid 3, the powder tray 2 and the pump seat 27 can freely move along an axial direction of the inner lid 3 without falling out of the inner lid 3. Powder outlet 31 is formed in a top of the inner lid 3. Pump pressure rod 32 is fixedly provided at a bottom of the inner lid 3. The pump pressure rod 32 is configured to move along an axial direction in an inner ring of the pump seat 27. Hollow pump connecting rod 33 is fixedly provided in a center of the pump pressure rod 32. The hollow pump connecting rod may also not be provided in the center of the pump pressure rod, which is a known replacement technology and also falls into a scope of protection of the embodiment. A side of the hollow pump connecting rod 33 away from the inner lid 3 is provided with powder inlet 331. The powder inlet 331 is communicated with a hollow portion of the hollow pump connecting rod 33. The powder outlet 31 is communicated with the powder inlet 331 through the hollow portion of the pump connecting rod 33, such that the cosmetic powder 5 can flow out of the cosmetic container. The end of the pump connecting rod 33 away from the inner lid 3 is provided with limit protrusion 332. Pump piston 34 is slidably sleeved on the pump connecting rod 33. The limit protrusion 332 is configured to stop the pump piston 34 from sliding out of the pump connecting rod 33. The pump piston 34 is configured to close and open the powder inlet 331. The inner ring of the pump seat 27 is slidably sleeved on the pump piston 34. Pump spring 25 is further provided. One end of the pump spring 25 elastically abuts against the pump pressure rod 32, and the other end of the pump spring 25 is fixed. After the button 43 is released, the powder tray is restored through an elastic force of the pump spring 25. When the powder tray 2 gets close to the inner lid 3, the pump seat 27 in a portion of the pump piston 34 close to the powder tray 2 has a smaller space and a greater air pressure, such that the pump piston 34 moves toward the pump pressure rod 32 to expose the powder inlet 331. In this process, a negative pressure is generated, such that the cosmetic powder 5 enters the powder inlet 331 and goes out from the powder outlet 31. When the powder tray 2 gets way from the inner lid 3, the pump seat 27 in the portion of the pump piston 34 close to the powder tray 2 has a larger space and a smaller air pressure, such that the pump piston 34 slides to the limit protrusion 332 and shields the powder inlet 331 for restoration.

Button assembly 4 includes button seat 41, button spring 42, and the button 43. The button seat 41 is provided at a bottom of the lower lid 12. The button 43 is slidably provided on the button seat 41. One end of the button 43 is provided in the open side of the lower lid 12, and the other end of the button 43 is configured to stretch into a space under the oblique protrusion 26. The button spring 42 is provided between the button seat 41 and the button 43. When the button 43 is pressed, the other end of the button 43 stretches into the space under the oblique protrusion 26 to lift the powder tray 2.

There is a following specific movement process in the embodiment: When the button 43 is pressed, the button spring 42 is compressed. The other end of the button 43 stretches into the space under the oblique protrusion 26 to lift the powder tray 2. The lifted powder tray 2 is close to the inner lid 3 and compresses the pump spring 25. The pump seat 27 is close to the pump pressure rod 32. An air pressure in the pump seat 27 is increased, such that the pump piston 34 is lifted to expose the powder inlet 331. In this process, a negative pressure is generated to suck out the cosmetic powder 5 from the annular chamber 21. When the button 43 is released, the pump spring 25 and the button spring 42 are restored, and the powder tray 2 is lowered. The pump seat 27 in the portion of the pump piston 34 close to the powder tray 2 has a larger space and a smaller air pressure. The pump piston 34 slides the limit protrusion 332 and shields the powder inlet 331 for restoration.

In the embodiment, preferably, a side of the lower lid 12 is provided with button aperture. One end of the button 43 is provided at the button aperture, and the other end of the button 43 is configured to stretch into the space under the oblique protrusion 26. By providing the button aperture alone at the side of the lower lid 12, a press operation can be more convenient.

In the embodiment, preferably, the inner lid 3 is elastically and detachably clamped at the upper aperture of the lower lid 12, so as to mount and dismount the liner conveniently.

In the embodiment, preferably, the other end of the pump spring 25 elastically abuts against the pump body 23. This can make the overall structure more compact and the layout more reasonable.

In the embodiment, preferably, two oblique protrusions 26 are symmetrically provided at the bottom of the powder tray 2. With the two symmetrical oblique protrusions 26, the pressure in the lifting process is more balanced, and the operation is more stable.

In the embodiment, preferably, the inner lid 3 is elastically clamped with the lower lid 12 through fastener 35. With the fastener 35 for elastic clamping, the liner can be mounted and dismounted more conveniently.

In the embodiment, preferably, an inner bottom of the upper lid 11 is provided with mirror 6. With the mirror 6 at the inner bottom of the upper lid 11, the cosmetic powder 5 can be conveniently applied to a correct position when used.

The cosmetic container in the embodiment can reduce contamination of the cosmetic when used, and can take out a required amount of the cosmetic powder to prevent waste. In addition, after the cosmetic is used up, the liner of the container can be replaced, thereby preventing the waste and being more environment-friendly.

What is claimed is:

1. A cosmetic container, comprising:

a housing comprising an upper lid and a lower lid, wherein a first side of the upper lid and a first side of the lower lid are hinged to each other, a second side of the upper lid and a second side of the lower lid each are an open side, and the open side is configured to be locked and unlocked;

a powder tray, wherein the powder tray and a pump seat are fixedly combined and form an annular chamber, cosmetic powder is provided in the annular chamber, a piston seals and covers an opening of the annular chamber, the piston is configured to slide on an inner wall of the annular chamber in a sealing manner, a pump body is nested in a center of the pump seat, a unidirectional pump valve communicated with the annular chamber is provided at a bottom of the pump seat, the pump valve is configured to allow the cosmetic powder to only flow out of the annular chamber unidirectionally, and an at least one oblique protrusion is provided at a bottom of the powder tray;

an inner lid detachably covering an upper aperture of the lower lid, wherein the inner lid and the lower lid are fixed relatively, the powder tray and the pump seat are axially and movably limited in a space under the inner lid, a powder outlet is formed in a top of the inner lid, a pump pressure rod is fixedly provided at a bottom of the inner lid, the pump pressure rod is annular and is configured to move along an axial direction in an inner ring of the pump seat, a hollow pump connecting rod is fixedly provided in a center of the pump pressure rod, where a proximal end of the hollow pump connecting rod disposed away from the inner lid is provided with a limit protrusion which forms a closed bottom wall of the hollow pump connecting rod, a powder inlet is provide through a lateral side of the hollow pump connecting rod disposed away from the inner lid and adjacent to the limit protrusion, the powder inlet is communicated with a hollow portion of the hollow pump connecting rod, the powder outlet is communicated with the powder inlet through the hollow portion of the hollow pump connecting rod, a pump piston is slidably sleeved on the hollow pump connecting rod, the limit protrusion is configured to stop the pump piston from sliding out of the hollow pump connecting rod, the pump piston is configured to close and open the powder inlet, the inner ring of the pump seat is slidably sleeved on the pump piston, wherein the pump piston is movable between (i) an open position in which the pump piston is shifted distally toward the pump pressure rod to expose the powder inlet when the powder tray is moved toward the inner lid, and (ii) a closed position in which the pump piston is shifted proximally toward the limit protrusion to shield the powder inlet when the powder tray is moved away from the inner lid; a pump spring is further provided, a first end of the pump spring elastically abuts against the pump pressure rod, and a second end of the pump spring is fixed; and a button assembly comprising a button seat, a button spring, and a button, wherein the button seat is provided at a bottom of the lower lid, the button is slidably provided on the button seat, a first end of the button assembly is provided in the open side of the lower lid, a second end of the button assembly is configured to slide into a space under the at least one oblique protrusion to lift the powder tray toward the inner lid, and the button spring is provided between the button seat and the button.

2. The cosmetic container according to claim 1, wherein a side of the lower lid is provided with a button aperture; and the first end of the button assembly defined by the button is provided at the button aperture, and a second end of the button assembly is configured to slide into the space under the at least one oblique protrusion.

3. The cosmetic container according to claim 1, wherein the inner lid is elastically and detachably clamped at the upper aperture of the lower lid.

4. The cosmetic container according to claim 1, wherein the second end of the pump spring elastically abuts against the pump body.

5. The cosmetic container according to claim 1, wherein the at least one oblique protrusion comprises two oblique protrusions symmetrically provided at the bottom of the powder tray.

6. The cosmetic container according to claim 3, wherein the inner lid is elastically clamped with the lower lid through a fastener thereby achieving locking and unlocking of the open side.

7. The cosmetic container according to claim 1, wherein an inner bottom of the upper lid is provided with a mirror.

8. The cosmetic container according to claim 2, wherein an inner bottom of the upper lid is provided with a mirror.

9. The cosmetic container according to claim 3, wherein an inner bottom of the upper lid is provided with a mirror.

10. The cosmetic container according to claim 4, wherein an inner bottom of the upper lid is provided with a mirror.

11. The cosmetic container according to claim 5, wherein an inner bottom of the upper lid is provided with a mirror.

12. The cosmetic container according to claim 6, wherein an inner bottom of the upper lid is provided with a mirror.

* * * * *